US009748701B2

(12) United States Patent
Tsai et al.

(10) Patent No.: US 9,748,701 B2
(45) Date of Patent: Aug. 29, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Long-Fei Chen, New Taipei (TW); Rui Su, New Taipei (TW); Chien-Tsung Chuang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/219,781

(22) Filed: Jul. 26, 2016

(65) Prior Publication Data

US 2017/0033507 A1 Feb. 2, 2017

(30) Foreign Application Priority Data

Jul. 31, 2015 (CN) ..... 2015 1 0461610

(51) Int. Cl.

| | |
|---|---|
| ***H01R 13/648*** | (2006.01) |
| ***H01R 13/6585*** | (2011.01) |
| ***H01R 13/6461*** | (2011.01) |
| ***H01R 24/62*** | (2011.01) |
| *H01R 107/00* | (2006.01) |

(52) U.S. Cl.

CPC ..... *H01R 13/6585* (2013.01); *H01R 13/6461* (2013.01); *H01R 24/62* (2013.01); *H01R 2107/00* (2013.01)

(58) Field of Classification Search

CPC ..... H01R 23/7073; H01R 23/688; H01R 13/65802; H01R 23/6873

USPC ..... 439/607.01, 607.05–607.09, 607.11, 439/607.27, 607.35, 607.36, 108, 79

See application file for complete search history.

(56) References Cited

U.S. PATENT DOCUMENTS

| | | | | |
|---|---|---|---|---|
| 8,961,235 | B2 * | 2/2015 | Little | H01R 13/64 439/374 |
| 9,022,800 | B2 * | 5/2015 | Yang | H01R 13/6581 439/487 |
| 9,178,319 | B2 * | 11/2015 | Little | H01R 13/6585 |
| 9,281,643 | B1 * | 3/2016 | Tseng | H01R 13/518 |
| 9,461,412 | B2 * | 10/2016 | Yu | H01R 13/6585 |
| 9,490,580 | B2 * | 11/2016 | Lan | H01R 13/646 |

(Continued)

*Primary Examiner* — Thanh Tam Le

(74) *Attorney, Agent, or Firm* — Muncy, Geissler, Olds & Lowe, P.C.

(57) ABSTRACT

An electrical receptacle connector includes a first terminal module, a grounding member, a second terminal module, and a metallic shell. The first terminal module includes a first insulated housing, a plurality of first terminals, and a grounding plate. The first insulated housing includes two grooves. The first terminals and the grounding plate are in the first insulated housing. A surface of the grounding plate is exposed from the first insulated housing. The grounding member includes two side protrusions and two protruding structures. The side protrusions are engaged with the grooves. The protruding structures are in contact with the grounding plate. The second terminal module is assembled to the first terminal module. The grounding member is between the first terminal module and the second terminal module.

15 Claims, 11 Drawing Sheets

(56) References Cited

U.S. PATENT DOCUMENTS

| | | | | |
|---|---|---|---|---|
| 9,502,827 | B2 * | 11/2016 | Chen | H01R 13/6581 |
| 2015/0244111 | A1 * | 8/2015 | Ju | H01R 13/6585<br>439/607.05 |

* cited by examiner

| | | | | | | | | | | | | |
|---|---|---|---|---|---|---|---|---|---|---|---|---|
| GND | TX1+ | TX1- | VBUS | CC1 | D+ | D- | SBU1 | VBUS | RX2- | RX2+ | GND | 31 |
| GND | RX1+ | RX1- | VBUS | SBU2 | D- | D+ | CC2 | VBUS | TX2- | TX2+ | GND | 41 |

FIG.11

ELECTRICAL RECEPTACLE CONNECTOR

CROSS-REFERENCES TO RELATED APPLICATIONS

This non-provisional application claims priority under 35 U.S.C. §119(a) on Patent Application No. 201510461610.6 filed in China, P.R.C. on Jul. 31, 2015, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. The purpose of the outer iron shell is mainly for shielding the electromagnetic waves produced by the receptacle terminals and preventing from the signal interference.

The tongue inside the conventional USB electrical receptacle connector may be damaged easily when an electrical plug connector is inserted into the receptacle connector with a wrong inserting orientation. As a result, the electrical receptacle connector having a damaged tongue portion has to be replaced, and the repair fee is costive. Therefore, an electrical receptacle connector capable of being mated with an electrical plug connector in two inserting orientations is developed. However, because of the widely applications of the USB connector, some problems are to be solved.

For example, the USB connectors are widely applied as the interface for high frequency signal emitters, radiofrequency signal emitters, wireless signal emitters, or Bluetooth emitters. The connector merely has the outer iron shell for enclosing the terminals and the insulated housing for holding the terminals to shield the electromagnetic waves, yet the shielding performance is insufficient. Furthermore, because the outer iron shell is formed by bending and folding a single metallic sheet, gaps may be formed between the intersections of different portions of the metallic sheet, and the holes reduce the shielding performance of the electromagnetic waves. As a result, the signals would be interfered by external noises during the signal transmission, and the quality of the signals is reduced.

In order to reduce the crosstalk between upper and lower terminals and to improve the shielding performance, a grounding plate is in the insulated housing. Therefore, the electromagnetic interferences can be reduced by the shielding of the outer iron shell and the grounding plate. However, some difficulties are encountered in the manufacturing of the connector having the aforementioned features. Commonly, the terminals and the grounding plate are in the insulated housing by insert-molding techniques. Because the terminals have longer lengths and each may have several turning portions, the terminals have to be positioned by fixtures to prevent from being shifted during the molding procedure. Similarly, in order to position the grounding plate during the molding procedure, the turning portions of the grounding plate are provided with several openings for the insertion of the fixtures. Consequently, the manufacturing of the one-piece grounding plate becomes complicated; in addition, the openings would reduce the structural strength of the grounding plate, and the grounding plate may be deformed during the manufacturing process. As a result, the product defect-free rate would decrease.

SUMMARY OF THE INVENTION

Therefore, how to improve the shielding performance, how to reduce the crosstalking, the radiofrequency interference (RFI), and the electromagnetic interference (EMI), and how to improve the product defect-free rate for the connector become issues for the connector manufacturers.

In view of this, an embodiment of the instant disclosure provides an electrical receptacle connector. The electrical receptacle connector comprises a first terminal module, a grounding member, a second terminal module, and a metallic shell. The first terminal module comprises a first insulated housing, a plurality of first terminals, and a grounding plate. The first insulated housing comprises two grooves at two sides thereof. The first terminals and the grounding plate are in the first insulated housing. At least one portion of each of the first terminals is exposed from the first insulated housing. A surface of the grounding plate is exposed from the first insulated housing. The grounding member comprises two side protrusions and two protruding structures. The two side protrusions are engaged with the two grooves, so that the grounding member and the first insulated housing are assembled with each other. The protruding structures are respectively extending from the side protrusions, and the protruding structures are in contact with the grounding plate for forming a grounding circuit. The second terminal module is assembled to the first terminal module. The grounding member is between the first terminal module and the second terminal module. The second terminal module comprises a second insulated housing and a plurality of second terminals. The second terminals are in the second insulated housing. At least one portion of each of the second terminals is exposed from the second insulated housing. The metallic shell encloses the first terminal module and the second terminal module, and the metallic shell defines an insertion opening.

In one embodiment, the grounding member comprises a first portion and a second portion. The first portion and the second portion are connected with each other by the connecting portion. The first portion is bent by an angle with respect to the second portion. The protruding structures and the side protrusions are extending from the first portion. The side protrusions are respectively extending from two sides of the first portion along a first direction, the protruding structures are extending from the first portion along a second direction, and the first direction is different from the second direction. The second portion further comprises two extension plates extending from two sides thereof. Each of the extension plates is of L shape and comprises a first part and a second part connected to the first part. The first part is bent by an angle with respect to the second part.

Furthermore, the first portion further comprises two partition slots each near to the corresponding protruding structure, so that each of the protruding structures and a portion of the first portion connected to the protruding structure form a flexible piece.

In one embodiment, the first insulated housing comprises a first base portion, a first tongue portion, and two lateral blocking members. The first tongue portion is extending from one end of the first base portion. A first connecting surface is between the first tongue portion and an upper surface of the first base portion, and a height difference is between the first tongue portion and the upper surface of the first base portion. The lateral blocking members are at two sides of the first base portion and two sides of the first tongue portion, and the lateral blocking members are partially overlapped with the upper surface of the first base portion. Each of the lateral blocking members comprises the groove and a notch, the grooves are at two sides of the first connecting surface, and the notches allow the upper surface of the first base portion to be exposed. The first part of each of the extension plates is engaged in the notch of the corresponding lateral blocking member, and the first parts are in contact with the upper surface of the first base portion.

In one embodiment, a width of an upper portion of each of the grooves is greater than a width of a lower portion of the groove. For example, the groove may be inverted-triangle shaped or V shaped. Therefore, when the side protrusions are inserted into the grooves, the side protrusions can be fixed with the lateral blocking members.

In one embodiment, the second insulated housing comprises a second base portion and a second tongue portion, and the second tongue portion is extending from one end of the second base portion. A second connecting surface is between the second tongue portion and an upper surface of the second base portion, and a height difference is between the second tongue portion and the upper surface of the second base portion. A portion of each of the second terminals is protruding from the second tongue portion toward an extension direction of the second tongue portion. A lower surface of the second tongue portion is connected to the upper surface of the first tongue portion. The grounding member is between the first connecting surface and the second connecting surface, and the grounding member is between the upper surface of the first base portion and a lower surface of the second base portion. The first tongue portion and the second tongue portion are in the insertion opening. The second tongue portion comprises two openings at a bottom thereof, so that portions of two outmost terminals of the second terminals are exposed from the second insulated housing and in contact with the protruding structures of the grounding member for forming the grounding circuit.

In one embodiment, the electrical receptacle connector further comprises a first conductive sheet and a second conductive sheet. The first conductive sheet is disposed on the upper surface of the second tongue portion and shields the second terminals, and the second conductive sheet is disposed on the lower surface of the first tongue portion. Therefore, great shielding performance can be provided, and electromagnetic interference (EMI) and radiofrequency (RFI) to the connector can be reduced.

In one embodiment, the second terminals comprise a plurality of second signal terminals, at least one second power terminal, and at least two second ground terminals. The second ground terminals are at two sides of the second terminals. Each of the second terminals comprises a second flat contact portion, a second body portion, and a second tail portion. The second flat contact portions are in the second tongue portion and partially protruding from the second tongue portion. The second body portions are held in the second base portion and the second tongue portion. Each of the second body portions is extending between the corresponding second flat contact portion and the corresponding second tail portion. The second tail portions are protruding from the lower surface of the second base portion.

In one embodiment, the first terminals comprise a plurality of first signal terminals, at least one first power terminal, and at least two first ground terminals. The first ground terminals are at two sides of the first terminals. Each of the first terminals comprises a first flat contact portion, a first body portion, and a first tail portion. The first flat contact portions are in the first tongue portion and partially protruding from the first tongue portion. The first body portions are held in the first base portion and the first tongue portion, and each of the first body portions is extending between the corresponding first flat contact portion and the corresponding first tail portion. The first tail portions are protruding from the lower surface of the first tongue portion. The positions of the first terminals correspond to the positions of the second terminals, and the first terminals are not in contact with the second terminals.

In one embodiment, the grounding plate comprises a plurality of positioning holes for positioning the first terminals.

In one embodiment, the first signal terminals are at the first tongue portion, and the second signal terminals are at the second tongue portion. The first terminals and the second terminals have 180 degree symmetrical design with respect to a central point of a receptacle cavity enclosed by the metallic shell as the symmetrical center.

In one embodiment, the electrical receptacle connector further comprises an outer shell enclosing the metallic shell and engaging with the metallic shell.

In one embodiment, the second tongue portion comprises two openings at a bottom thereof, so that portions of two outmost terminals of the second terminals are exposed from the second insulated housing and in contact with the protruding structures of the grounding member.

According to the embodiment of the instant disclosure, the conventional one-piece grounding plate is separated to be the grounding member, which is out of the first insulated housing, and the grounding plate, which is in the first insulated housing. The grounding member and the grounding plate are assembled to the first insulated housing separately. Therefore, the grounding member and the grounding plate do not need the gaps for inserting fixtures. As a result, the manufacturing of the grounding member and the grounding plate becomes easier, the structural strength of these components can be improved, and the product defect-free rate of the connector can be improved.

In addition, since the grounding member and the grounding plate do not have the gaps, the shielding performance can also be improved. Furthermore, since the grounding plate and the grounding member can be produced separately and can be adapted to other connectors having similar structures, the manufacturing of the connector can be more efficient.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 11 illustrates a schematic configuration diagram of the receptacle terminals of the electrical receptacle connector shown in FIG. 10.

DETAILED DESCRIPTION

Figure 1:
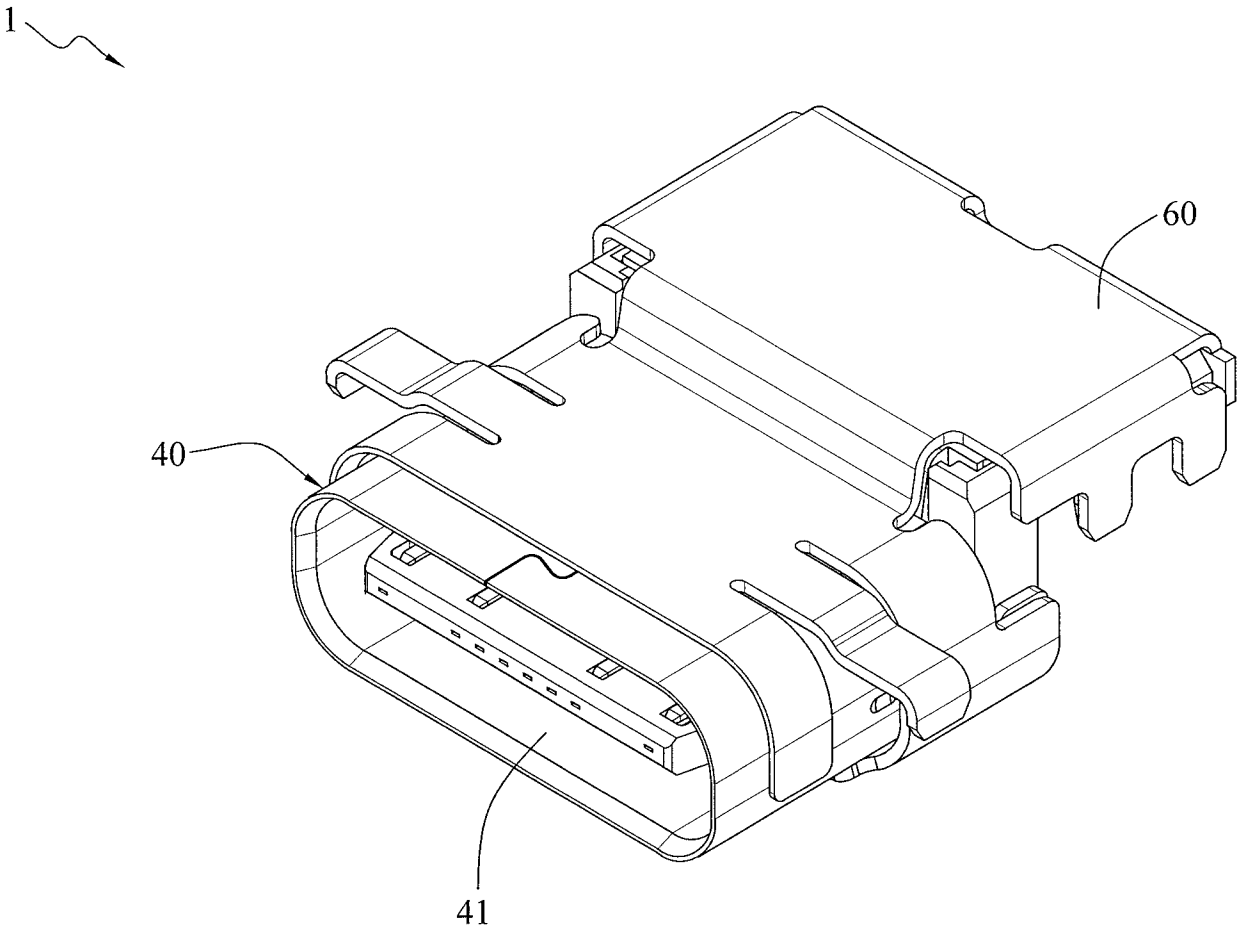
FIG. 1 illustrates a perspective view of an electrical receptacle connector of one embodiment of the instant disclosure.
Figure 2:
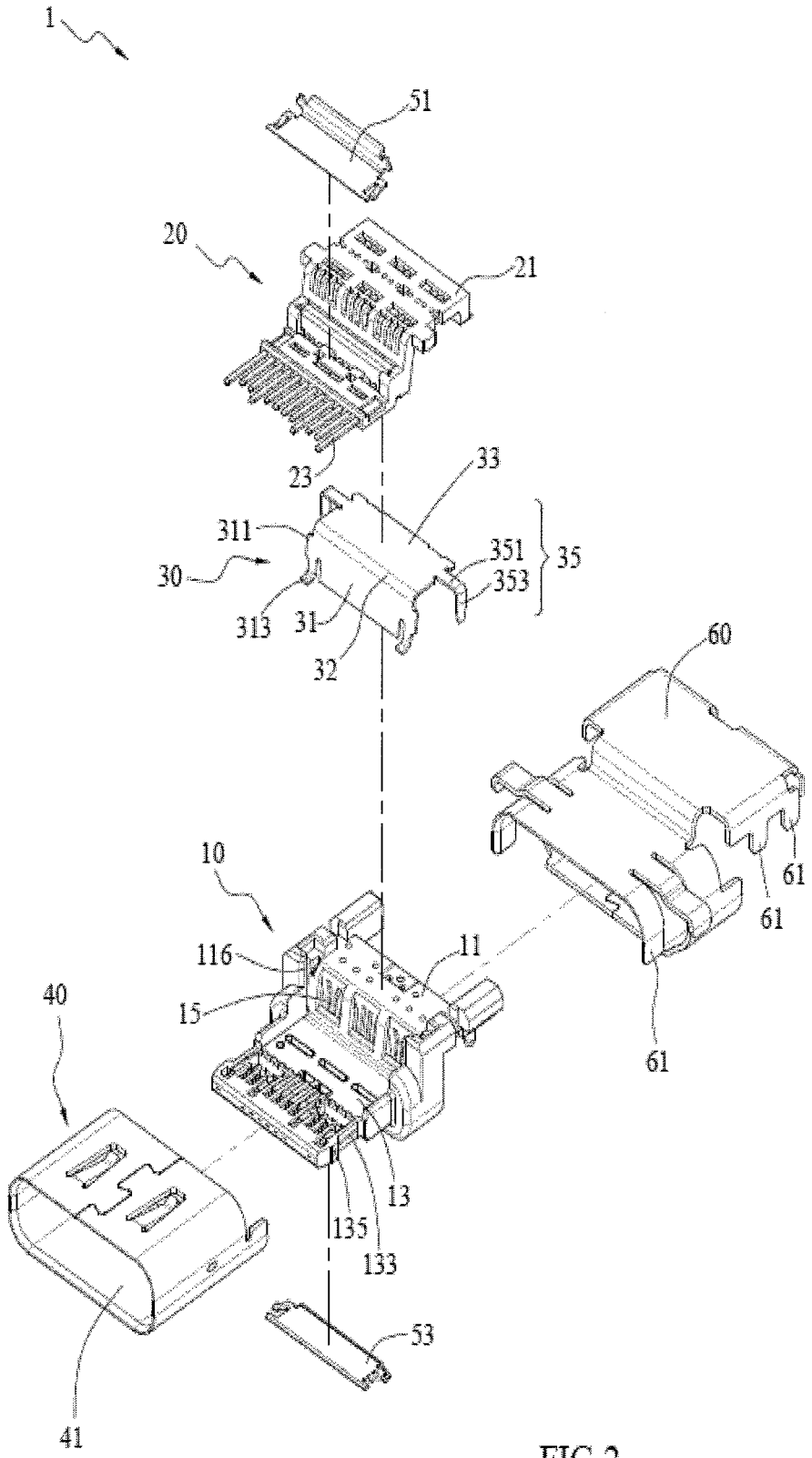
FIG. 2 illustrates an exploded view of the electrical receptacle connector of one embodiment of the instant disclosure.
Figure 3:
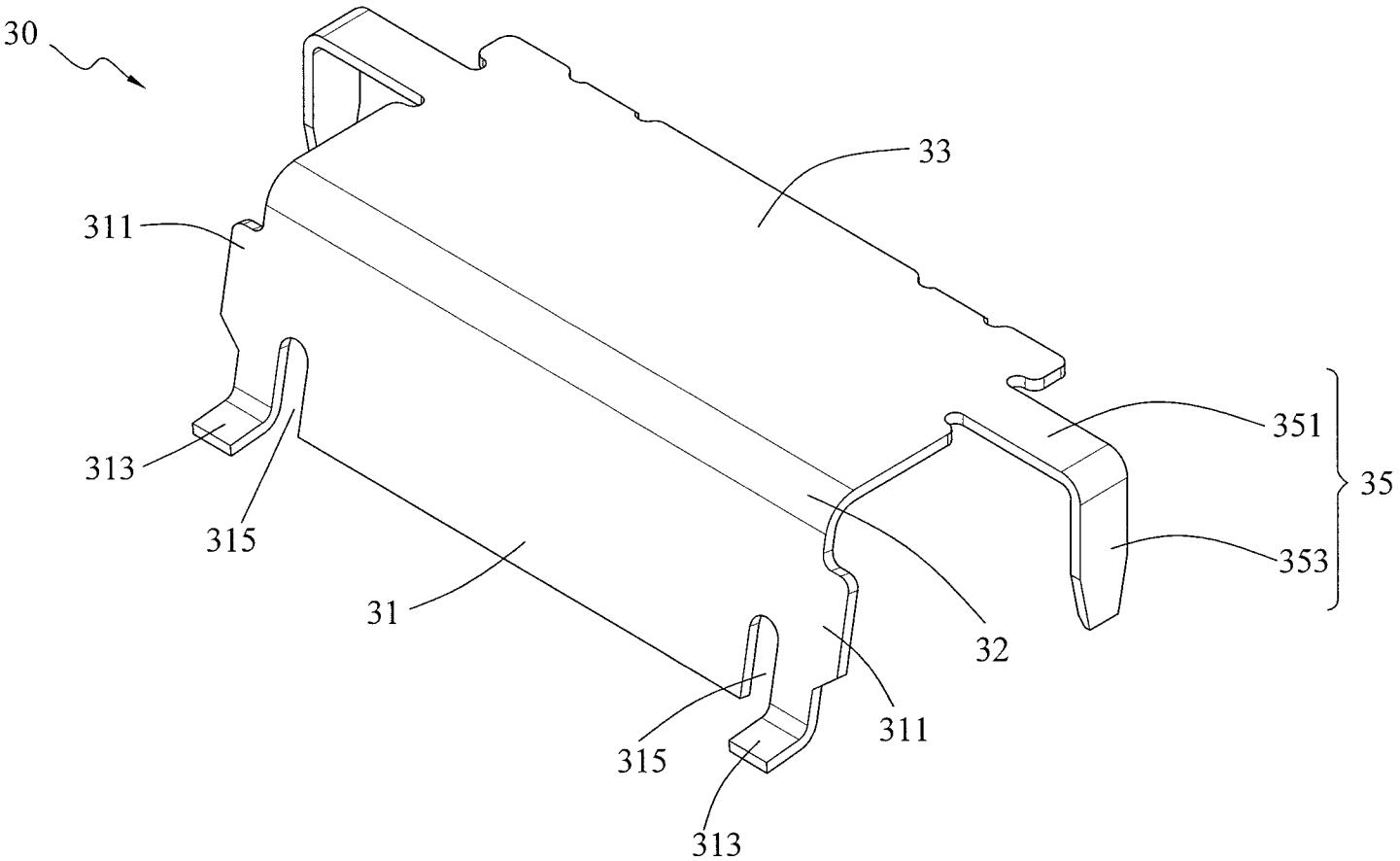
FIG. 3 illustrates a perspective view of a grounding member of the electrical receptacle connector of one embodiment of the instant disclosure.

Please refer to FIGS. 1 and 2, which illustrate an electrical receptacle connector 1 of an exemplary embodiment of the instant disclosure. FIG. 1 and FIG. 2 respectively illustrate a perspective view and an exploded view of an electrical receptacle connector of one embodiment of the instant disclosure. As shown in FIGS. 1 and 2, one embodiment of the electrical receptacle connector 1 comprises a first terminal module 10, a second terminal module 20, a grounding member 30, and a metallic shell 40. The grounding member 30 is between the first terminal module 10 and the second terminal module 20. The metallic shell 40 encloses the assembly of the first terminal module 10 and the second terminal module 20. The metallic shell 40 has an insertion opening 41, and the first terminal module 10 and the second terminal module 20 are in the insertion opening 41.

Figure 4:
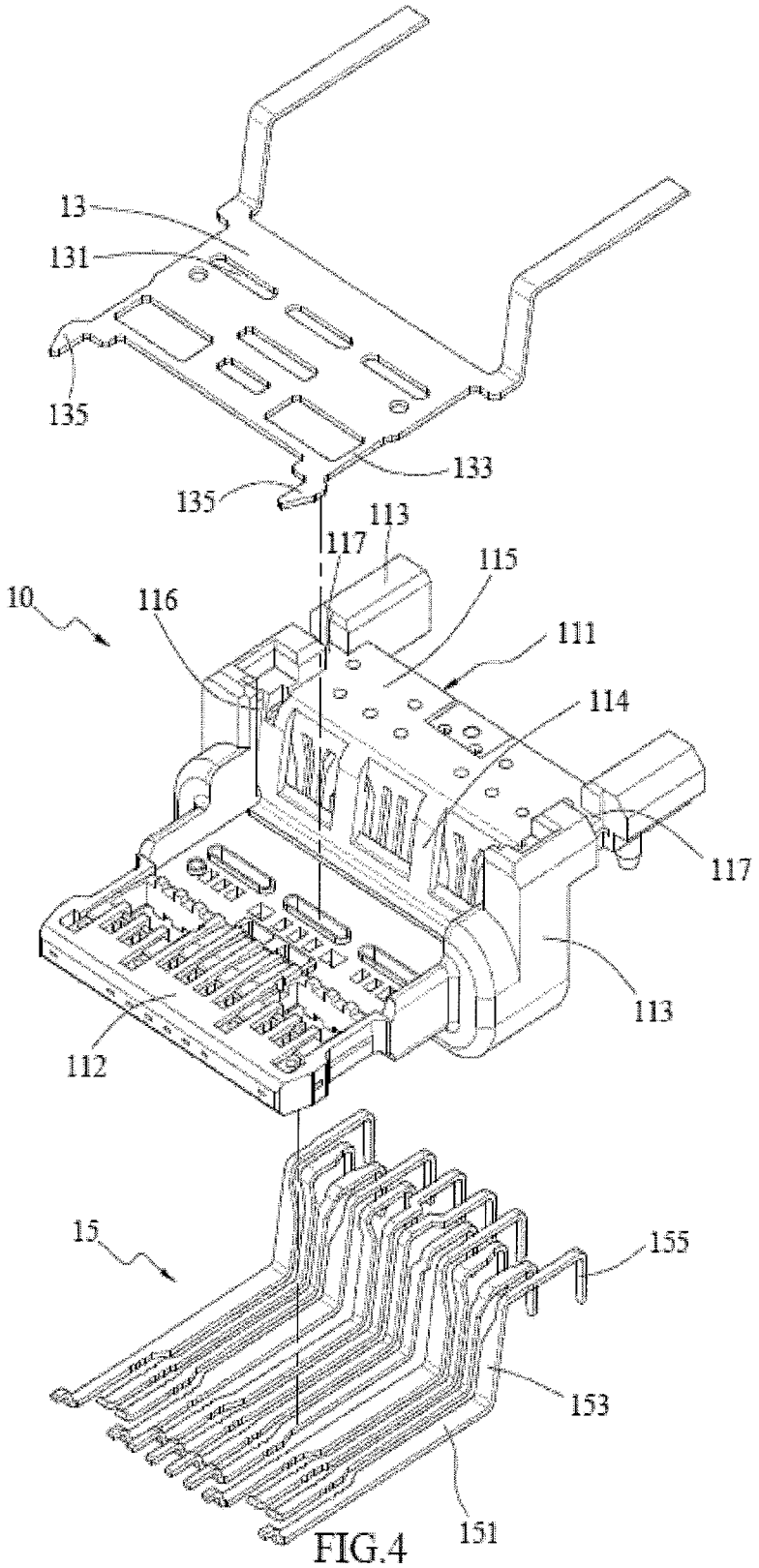
FIG. 4 illustrates an exploded view of a first terminal module of the electrical receptacle connector of one embodiment of the instant disclosure.
Figure 5:
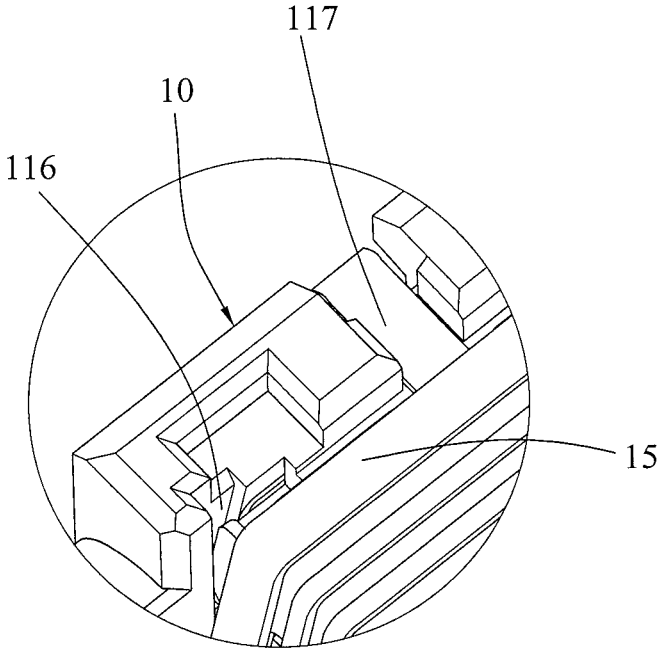
FIG. 5 illustrates a partial enlarged view of FIG. 4.

Please refer to FIGS. 3 to 6, respectively illustrating a perspective view of the grounding member 30, an exploded view of the first terminal module 10, a partial enlarged view of FIG. 4, and an exploded view of the second terminal module 20. Please refer to FIGS. 2 and 5. The first terminal module 10 comprises a first insulated housing 11, a grounding plate 13, and a plurality of first terminals 15. The first terminals 15 and the grounding plate 13 are in the first insulated housing 11. At least one portion of each of the first terminals 15 is exposed from the first insulated housing 11, and a surface of the grounding plate 13 is exposed from the first insulated housing 11. In detail, as shown in FIGS. 2 and 4, the grounding plate 13 comprises two side portions 133 and two hook portion 135. The side portions 133 are at two sides of the grounding plate 13. The hook portion 135 is extending forward from the side portions 133. Part of the side portions 133 and two hook portion 135 are exposed from the first insulated housing 11. The first insulated housing 11 comprises a first base portion 111, a first tongue portion 112, and two lateral blocking members 113. The first tongue portion 112 is extending from one end of the first base portion 111. A first connecting surface 114 is between the first tongue portion 112 and an upper surface 115 of the first base portion 111, and a height difference is between the first tongue portion 112 and the upper surface 115 of the first base portion 111. The lateral blocking members 113 are at two sides of the first base portion 111 and two sides of the first tongue portion 112, and the lateral blocking members 113 are partially overlapped with the upper surface 115 of the first base portion 111. Each of the lateral blocking members 113 comprises a groove 116, and the grooves 116 are at two sides of the first connecting surface 114. The depth direction of the groove 116 may be parallel to the extension direction (i.e., the length direction) of the first connecting surface 114. Moreover, a width of an upper portion of the groove 116 is greater than a width of a lower portion of the groove 116, for example, the groove 116 may be inverted-triangle shaped or V shaped. In addition, each of the lateral blocking members 115 further comprises a notch 117, the two notches 117 are at the two sides of the first insulated housing 10, and the two notches 117 allow the upper surface 115 of the first base portion 111 to be exposed. The grounding plate 13 comprises a plurality of positioning holes 131 for positioning the first terminals 15 during the insert-molding procedure.

Please refer to FIGS. 2 to 5. The grounding member 30 comprises a first portion 31 and a second portion 33. The grounding member 30 is a one-piece member, the first portion 31 and the second portion 33 are connected with each other by a connecting portion 32, and the first portion 31 is bent by an angle with respect to the second portion 33. For example, the first portion 31 may be substantially perpendicular to the second portion 33. The first portion 31 comprises two side protrusions 311 and two protruding structures 313. The two side protrusions 311 are respectively protruding from two sides of the first portion 31 along a first direction for engaging with the grooves 116, so that the grounding member 30 can be assembled with the first insulated housing 11. The shape of the grooves 116 allows the side protrusions 311 to be fixed with and abutted against the lateral blocking members 113. The two protruding structures 313 are protruding from the first portion 31 along a second direction, and the second direction is different from the first direction. For example, the two protruding structures 313 may be parallel to the second portion 33 and perpendicular to the extension direction (i.e., the first direction) of the two side protrusions 311. After the first insulated housing 11 is assembled to the grounding member 30, the protruding structures 313 are abutted against the grounding plate 13 to form a grounding circuit.

The second portion 33 further comprises two extension plates 35, and the extension plates 35 are extending from two sides of the second portion 33. Each of the extension plates 35 comprises a first part 351 and a second part 353 connected to the first part 351, and the first part 351 is bent by an angle with respect to the second part 353. For example, the second part 353 may be perpendicular to the first part 351. The first part 351 of each of the extension plates 35 is engaged in the notch 117 of the corresponding lateral blocking member 113 and in contact with the upper surface 115 of the first base portion 111. In addition, the first portion 31 comprises two partition slots 315 each near to the corresponding protruding structure 313, so that each of the protruding structures 313 and a portion of the first portion 31 connected to the protruding structure 313 form a flexible piece. After the grounding member 30 is assembled to the first insulated housing 11, the grounding member 30 shields the upper surface 115 of the first base portion 111 and the first connecting surface 114.

Figure 6:
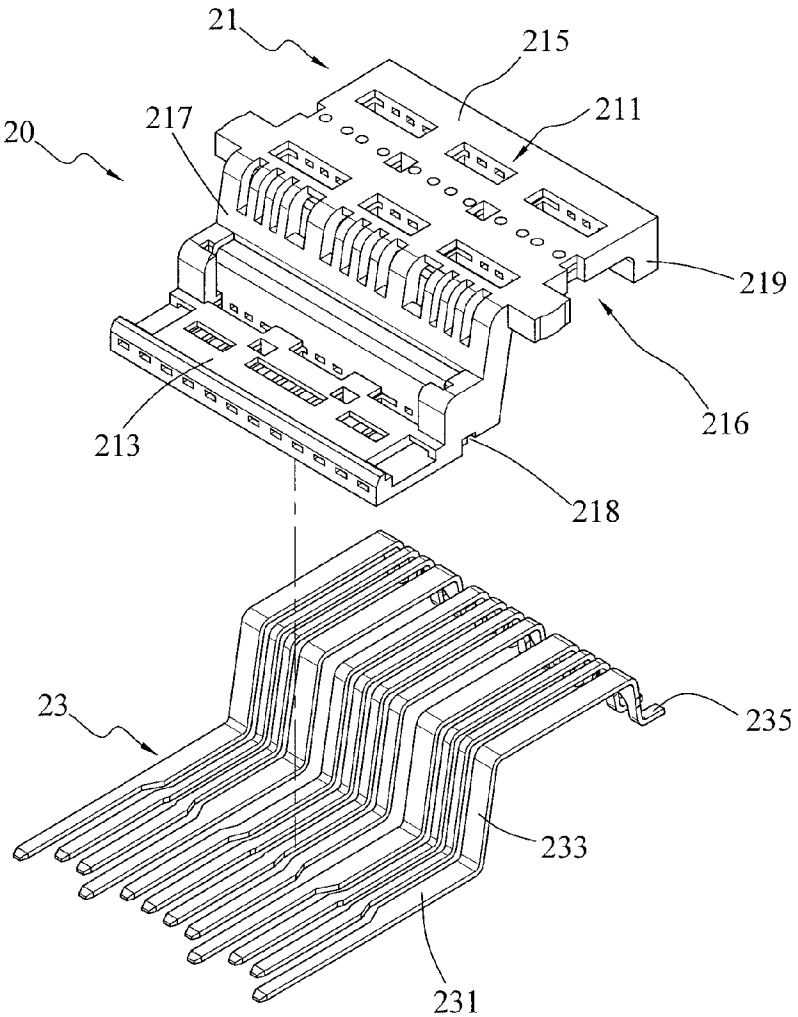
FIG. 6 illustrates an exploded view of a second terminal module of the electrical receptacle connector of one embodiment of the instant disclosure.

Please refer to FIGS. 2 and 6. The second terminal module 20 comprises a second insulated housing 21 and a plurality of second terminals 23. The second insulated housing 21 comprises a second base portion 211 and a second tongue portion 213. The second tongue portion 213 is extending from one end of the second base portion 211. A second connecting portion 217 is between the second tongue portion 213 and an upper surface 215 of the second base portion 213, and a height difference is between the second tongue portion 213 and the upper surface 215 of the second base portion 211. At least one portion of each of the second terminals 23 is exposed from the second insulated housing 21. For example, a portion of each of the second terminals 23 is extending toward and protruding from the second tongue portion 213. The first terminal module 10, the second terminal module 20, and the grounding member 30 correspond to each other in structure. When the second terminal module 20 is assembled to the first terminal module 10 to form a terminal module, a lower surface of the second tongue portion 213 is connected to an upper surface of the first tongue portion 112. After the assembling of the connector is finished, the grounding member 30 is between the first connecting surface 114 and the second connecting surface 217, and between the upper surface 115 of the first base portion 111 and the lower surface 216 of the second base portion 211.

Please refer to FIGS. 1, 2, 5, and 6. In one embodiment, the electrical receptacle connector 1 further comprises a first conductive sheet 51 and a second conductive sheet 53. The first conductive sheet 51 is disposed on the upper surface of the second tongue portion 213 and shields the second terminals 23. The second conductive sheet 53 is disposed on the lower surface of the first tongue portion 112. Therefore, upper and lower surfaces of the first terminals 15 and upper and lower surfaces of the second terminals 23 are shielded by metallic plates (i.e., the metallic shell 40 and the conductive sheets 51, 53), and the radiofrequency interference and electromagnetic interference can be reduced. The first conductive sheet 51 and the second conductive sheet 53 may be in contact with an electrical plug connector for grounding. The first conductive sheet 51 and the second conductive sheet 53 may be further in contact with the grounding plate 13, the metallic shell 40, and the ground terminals of the first and second terminals 15, 23, for forming the grounding circuits.

In one embodiment, the electrical receptacle connector 1 further comprises an outer shell 60 enclosing the metallic shell 40 and engaging with the metallic shell 40. After the assembling of the connector is finished, the first tongue portion 112 and the second tongue portion 213 are both in the insertion opening 41.

Figure 7:
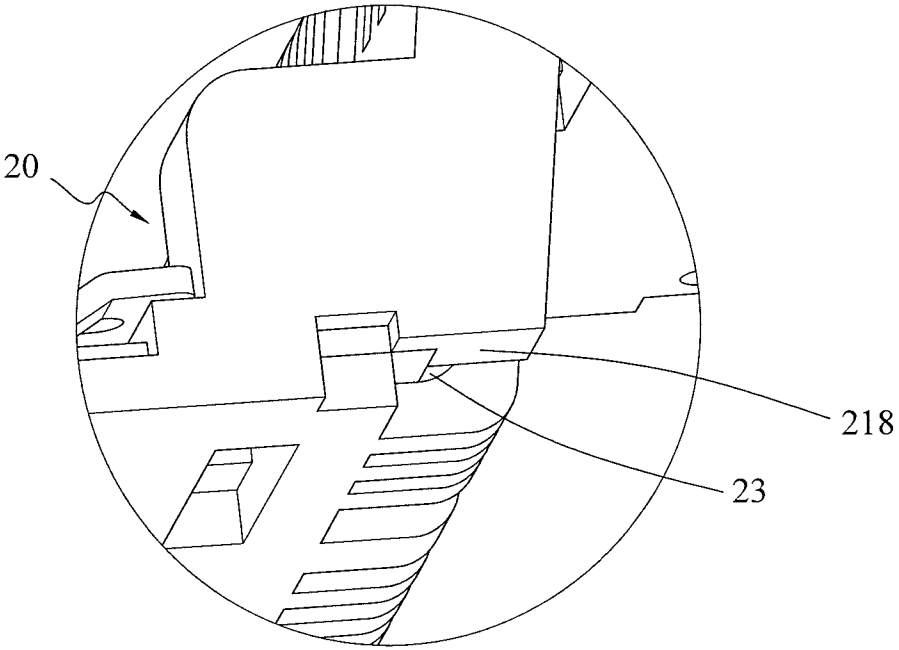
FIG. 7 illustrates a partial enlarged view of the bottom of a second terminal module of the electrical receptacle connector of one embodiment of the instant disclosure.
Figure 8:
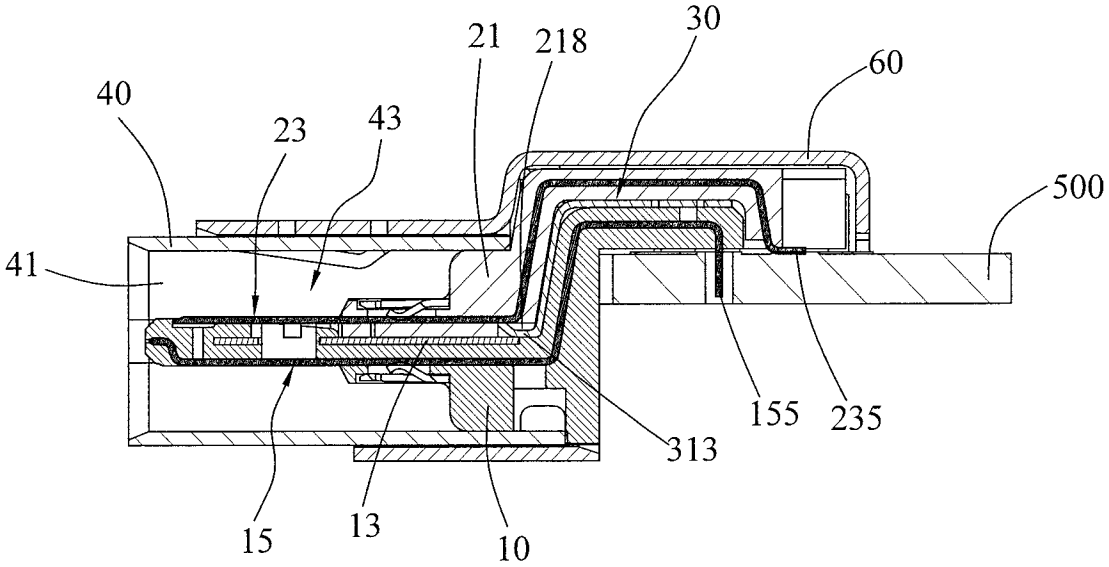
FIG. 8 illustrates a lateral sectional view of the electrical receptacle connector of one embodiment of the instant disclosure.
Figure 9:
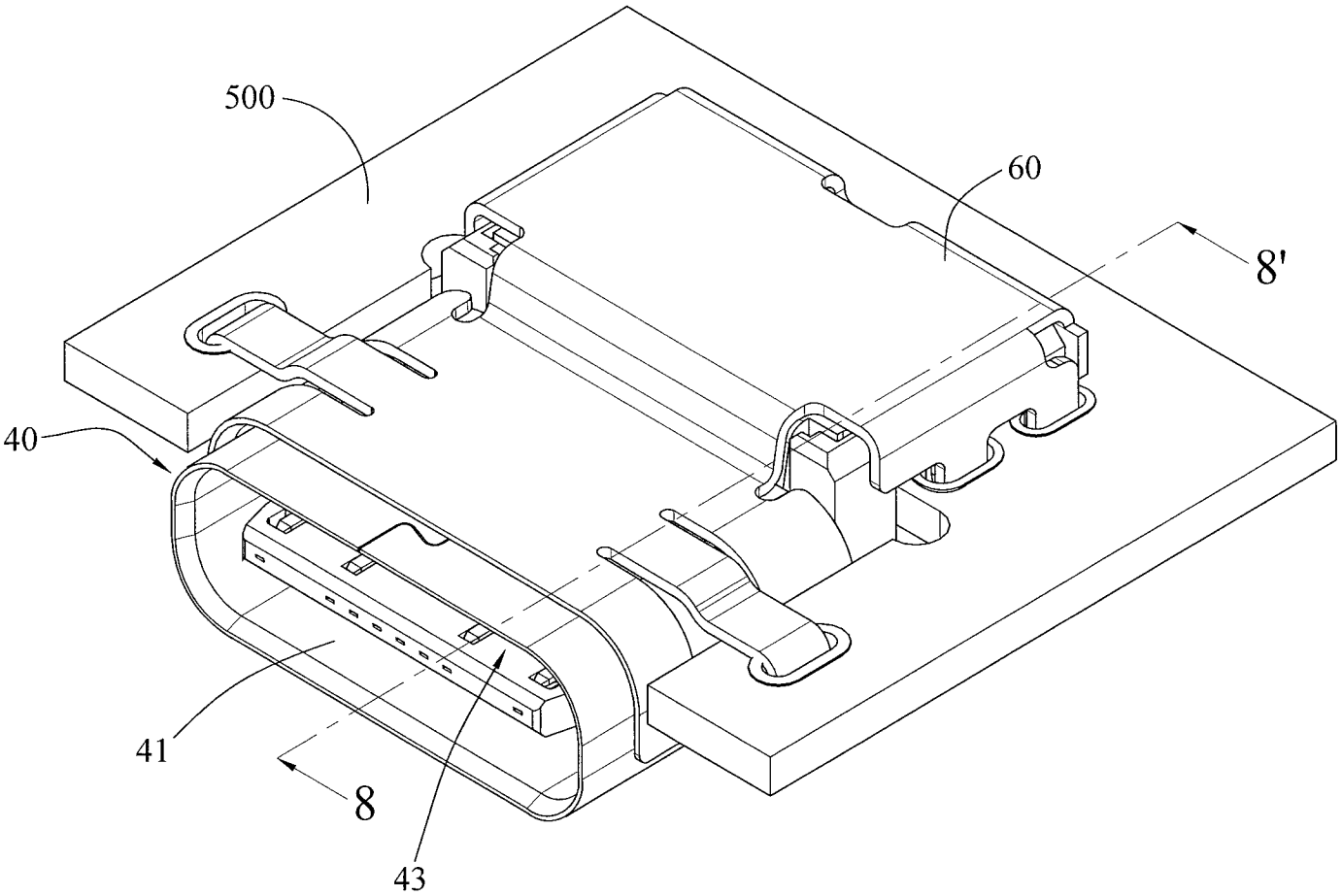
FIG. 9 illustrates an assembled view of the electrical receptacle connector of one embodiment of the instant disclosure.

Please refer to FIGS. 7 to 9. FIG. 7 illustrates a partial enlarged view of the bottom of a second terminal module of the electrical receptacle connector of one embodiment of the instant disclosure. FIG. 8 illustrates a lateral sectional view of the electrical receptacle connector of one embodiment of the instant disclosure. FIG. 9 illustrates an assembled view of the electrical receptacle connector of one embodiment of the instant disclosure. FIG. 8 is a sectional view along the line 8-8' shown in FIG. 9. As shown in FIGS. 7 to 9, the second tongue portion 213 comprises two openings 218, and the two openings 218 are at bottoms of two sides of the second tongue portion 213, so that portions of two outmost terminals of the second terminals 23 are exposed from the second insulated housing 21. In addition to being in contact with the grounding plate 13, the protruding structures 313 of the grounding member 30 are also in contact with the exposed portions of the second terminals 23. Commonly, for a USB connector, the outmost terminals of the second terminals 23 are ground terminals. Accordingly, the ground terminals of the second terminals 23, the grounding member 30, and the grounding plate 13 form the grounding circuit.

Please refer to FIGS. 2, and 4 to 8. Each of the first terminals 15 comprises a flat contact portion 151, a body portion 153, and a tail portion 155. The flat contact portion 151 is in the first tongue portion 112 and partially protruding from the first tongue portion 112. The shape of the body portion 153 correspond to the structure of the assembly of the first base portion 111, the first tongue portion 112, and the first connecting surface 114; that is, the body portion 153 is aligned with the surface of the first insulated housing 11. The body portions 153 are in the first tongue portion 112 and the first base portion 111. Each of the body portions 153 is extending between the corresponding flat contact portion 151 and the corresponding tail portion 155. The tail portions 155 are protruding from the lower surface of the first base portion 151 for being soldered on a circuit board 500. In one embodiment, the tail portions 155 are parallel to the second part 353 of the extension plate 35, so that the first terminals 15 can be soldered on the circuit board 500 conveniently. Each of the second terminals 23 comprises a flat contact portion 231, a body portion 233, and a tail portion 235. The flat contact portions 231 are in the second tongue portion 213 and partially protruding from the second tongue portion 213. The body portions 233 are in the second base portion 211 and the second tongue portion 213. The shape of the body portion 233 correspond to the structure of the assembly of the second base portion 211, the second tongue portion 213, and the second connecting surface 217; that is, the body portion 233 is aligned with the surface of the second insulated housing 21. Each of the body portions 233 is extending between the corresponding flat contact portion 213 and the corresponding tail portion 235. The tail portions 235 are protruding from the lower surface 216 of the second base portion 211 for being soldered on the circuit board 500. In addition, the second base portion 211 comprises an elevation portion 219 protruding therefrom and corresponding to the tail portions 235, and the tail portions 235 are protruding from the elevation portion 219. The protruding direction of the tail portions 235 may be parallel to the second tongue portion 213. The position of the first terminals 15 corresponds to the position of the second terminals 23, and the first terminals 15 and the second terminals 23 are not in contact with each other by the separation of the first tongue portion 15 and the second tongue portion 23.

Figure 10:
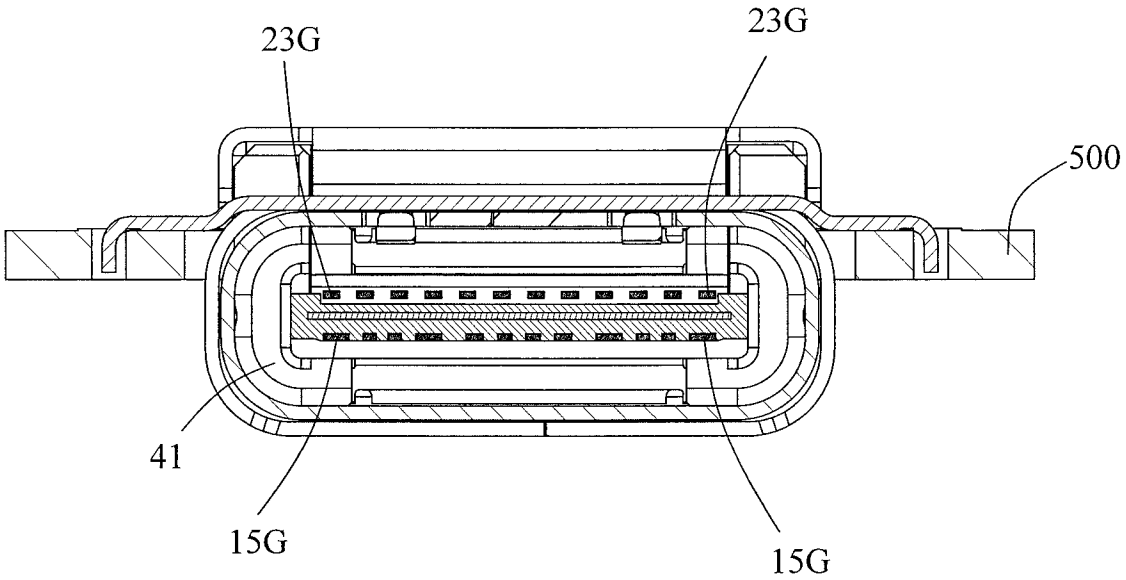
FIG. 10 illustrates a front sectional view of the electrical receptacle connector of one embodiment of the instant disclosure.

Please refer to FIGS. 10 and 11. FIG. 10 illustrates a front sectional view of the electrical receptacle connector of one embodiment of the instant disclosure. FIG. 11 illustrates a schematic configuration diagram of the receptacle terminals of the electrical receptacle connector shown in FIG. 10. As shown in FIGS. 9 to 11, the terminals at two sides of the first terminals 15 are ground terminals 15G, and the terminals at two sides of the second terminals 23 are ground terminals 23G. In addition, the first terminals 15 further comprise first signal terminals and power terminals, and the second terminals 23 further comprise second signal terminals and power terminals. For example, as shown in FIGS. 10 and 11, the second terminals 23 comprise, from left to right, a ground terminal (GND), first differential signal pairs (RX1+ and RX1−), a power terminal (VBUS), a second supplement terminal (SBU2), second differential signal pairs (D+ and D−), a second function detection terminal (CC2), another power terminal (VBUS), third differential signal pairs (TX2− and TX2+), and another ground terminal (GND). Likewise, as shown in FIGS. 10 and 11, the first terminals 15 comprise, from right to left, a ground terminal (GND), first differential pairs (RX1+ and RX1−), a power terminal (VBUS), a first supplement terminal (CC1), second differential pairs (D+ and D−), a first function detection terminal (CC1), another power terminal (VBUS), third differential pairs (TX1+ and TX1−), and another ground terminal (GND). Therefore, the twelve first terminals 15 and the twelve second terminals 23 are provided for transmitting USB 2.0 or USB 3.0 signals. The Pin-assignments of the first terminals 15 and the second terminals 23 are point-symmetrical with a central point of a receptacle cavity 43 enclosed by the metallic shell 40 as the symmetrical center. In other words, pin-assignments of the first terminals 15 and the second terminals 23 have 180 degree symmetrical design with respect to the central point of the receptacle cavity 43 as the symmetrical center. The dual or double orientation design enables an electrical plug connector to be inserted into the electrical receptacle connector 1 in either of two intuitive orientations, i.e., in either upside-up or upside-down directions.

Furthermore, the specification of first signals transmitted by the first signal terminals of the first terminals 15 is conformed to the specification of second signals transmitted by the second signal terminals of the second terminals 23. Therefore, an electrical plug connector is inserted into the electrical receptacle connector 1 with a first orientation where the upper surface of the first insulated housing 11 is facing up, for transmitting first signals. Conversely, the electrical plug connector is inserted into the electrical receptacle connector 1 with a second orientation where the upper surface of the first insulated housing 11 is facing down, for transmitting second signals.

Please refer to FIGS. 1, 8, and 9. After the first terminal module 10, the second terminal module 20, and the grounding member 30 are assembled with each other, the metallic shell 40 is provided to enclose the assembly of the first terminal module 10, the second terminal module 20, and the grounding member 30. Next, the outer shell 60 is connected to the metallic shell 40 and encloses the assembly. The outer shell 60 further shields the second base portion 211 and the second connecting surface 217. Lastly, the tail portions 155 of the first terminals 15, the tail portions 235 of the second terminals 23, and legs 61 of the outer shell 60 are soldered with the circuit board 500. Therefore, the electrical receptacle connector 1 is assembled with the circuit board 500.

According to the embodiment of the instant disclosure, the conventional one-piece grounding plate is separated to be the grounding member, which is out of the first insulated housing, and the grounding plate, which is in the first insulated housing. The grounding member and the grounding plate are assembled to the first insulated housing separately. Therefore, the grounding member and the grounding plate do not need the gaps for inserting fixtures. As a result, the manufacturing of the grounding member and the grounding plate becomes easier. In addition, since the grounding member and the grounding plate do not have the gaps, the structural strength of these components can be improved, and the product defect-free rate of the connector can be improved. Moreover, the shielding performance can also be improved. In addition, since the grounding plate and the grounding member can be produced separately and can be adapted to other connectors having similar structures, the manufacturing of the connector can be more efficient.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a first terminal module, comprising a first insulated housing, a plurality of first terminals, and a grounding plate, wherein the first insulated housing comprises two grooves at two sides thereof, the first terminals and the grounding plate are inside the first insulated housing, at least one portion of each of the first terminals is exposed from the first insulated housing, and a surface of the grounding plate is exposed from the first insulated housing;

a grounding member, comprising two side protrusions and two protruding structures, wherein the two side protrusions are engaged with the two grooves, so that the grounding member and the first insulated housing are assembled with each other, the protruding structures are respectively extending from the side protrusions, and the protruding structures are in contact with the grounding plate;

a second terminal module assembled to the first terminal module, wherein the grounding member is between the first terminal module and the second terminal module, the second terminal module comprises a second insulated housing and a plurality of second terminals, the second terminals are in the second insulated housing, and at least one portion of each of the second terminals is exposed from the second insulated housing; and a metallic shell enclosing the first terminal module and the second terminal module, wherein the metallic shell defines an insertion opening.

2. The electrical receptacle connector according to claim 1, wherein the grounding member comprises a first portion, a second portion, and a connecting portion, the first portion and the second portion are connected with each other by the connecting portion, and the first portion is bent by a first angle with respect to the second portion, wherein the protruding structures and the side protrusions are extending from the first portion, the side protrusions are respectively extending from two sides of the first portion along a first direction, the protruding structures are extending from the first portion along a second direction, and the first direction is different from the second direction, and wherein the second portion further comprises two extension plates extending from two sides thereof, each of the extension plate comprises a first part and a second part connected to the first part, and the first part is bent by a second angle with respect to the second part.

3. The electrical receptacle connector according to claim 2, wherein the first portion further comprises two partition slots each near to the corresponding protruding structure, so that each of the protruding structures and a portion of the first portion connected to the protruding structure form a flexible piece.

4. The electrical receptacle connector according to claim 2, wherein the first insulated housing comprises a first base portion, a first tongue portion, and two lateral blocking members, the first tongue portion is extending from one end of the first base portion, wherein a first connecting surface is between the first tongue portion and an upper surface of the first base portion, and a height difference is between the first tongue portion and the upper surface of the first base portion, wherein the lateral blocking members are at two sides of the first base portion and two sides of the first tongue portion, and the lateral blocking members are partially overlapped with the upper surface of the first base portion, wherein each of the lateral blocking members comprises the groove and a notch, the grooves are at two sides of the first connecting surface, and the notches allow the upper surface of the first base portion to be exposed, and wherein the first part of each of the extension plates is engaged in the notch of the corresponding lateral blocking member, and the first parts are in contact with the upper surface of the first base portion.

5. The electrical receptacle connector according to claim 4, wherein a width of an upper portion of each of the grooves is greater than a width of a lower portion of the groove.

6. The electrical receptacle connector according to claim 4, wherein the second insulated housing comprises a second base portion and a second tongue portion, the second tongue portion is extending from one end of the second base portion, and a second connecting surface is between the second tongue portion and an upper surface of the second base portion, and a height difference is between the second tongue portion and the upper surface of the second base portion, wherein a portion of each of the second terminals is protruding from the second tongue portion toward an extension direction of the second tongue portion, wherein a lower surface of the second tongue portion is connected to the upper surface of the first tongue portion, wherein the grounding member is between the first connecting surface and the second connecting surface, and the grounding member is also between the upper surface of the first base portion and a lower surface of the second base portion, wherein the first tongue portion and the second tongue portion are in the insertion opening, and wherein the second tongue portion comprises two openings at a bottom thereof, so that portions of two outmost terminals of the second terminal s are exposed from the second insulated housing and in contact with the protruding structures of the grounding member.

7. The electrical receptacle connector according to claim 6, further comprising a first conductive sheet and a second conductive sheet, wherein the first conductive sheet is disposed on the upper surface of the second tongue portion and shields the second terminals, and the second conductive sheet is disposed on the lower surface of the first tongue portion.

8. The electrical receptacle connector according to claim 6, wherein the second terminal s comprise a plurality of second signal terminals, at least one second power terminal, and at least two second ground terminals, and the second ground terminals are at two sides of the second terminals, wherein each of the second terminals comprises a second flat contact portion, a second body portion, and a second tail portion, wherein the second flat contact portions are in the second tongue portion and partially protruding from the second tongue portion, wherein the second body portions are held in the second base portion and the second tongue portion, and each of the second body portions is extending between the corresponding second flat contact portion and the corresponding second tail portion, and wherein the second tail portions are protruding from the lower surface of the second base portion.

9. The electrical receptacle connector according to claim 6, wherein the second tongue portion comprises two openings at a bottom thereof, so that portions of two outmost terminals of the second terminals are exposed from the second insulated housing and in contact with the protruding structures of the grounding member.

10. The electrical receptacle connector according to claim 8, wherein the first terminals comprise a plurality of first signal terminals, at least one first power terminal, and at least two first ground terminals, and the first ground terminals are at two sides of the first terminals, wherein each of the first terminals comprises a first flat contact portion, a first body portion, and a first tail portion, wherein the first flat contact portions are in the first tongue portion and partially protruding from the first tongue portion, wherein the first body portions are held in the first base portion and the first tongue portion, and each of the first body portions is extending between the corresponding first flat contact portion and the corresponding first tail portion, wherein the first tail portions are protruding from the lower surface of the first tongue portion, and wherein the positions of the first terminals correspond to the positions of the second terminals, and the first terminals are not in contact with the second terminals.

11. The electrical receptacle connector according to claim 10, wherein the grounding plate comprises a plurality of positioning holes for positioning the first terminals.

12. The electrical receptacle connector according to claim 10, wherein the first signal terminals are at the first tongue portion, and the second signal terminals are at the second tongue portion, the first terminals and the second terminals have 180 degree symmetrical design with respect to a central point of a receptacle cavity enclosed by the metallic shell as the symmetrical center.

13. The electrical receptacle connector according to claim 1, further comprising an outer shell enclosing the metallic shell and engaging with the metallic shell.

14. The electrical receptacle connector according to claim 1, wherein the grounding plate comprises two side portions and two hook portion, the side portions are at two sides of the grounding plate, the hook portion is extending forward from the side portions, and part of the side portions and two hook portion are exposed from the first insulated housing.

15. An electrical receptacle connector, comprising:

a terminal module comprising a first terminal module and a second terminal module coupled to each other, wherein:

the first terminal module, comprising a first insulated housing, a plurality of first terminals, and a grounding plate, wherein the first insulated housing comprises two grooves at two sides thereof, the first terminals and the grounding plate are inside the first insulated housing, at least one portion of each of the first terminals is exposed from the first insulated housing, and a surface of the grounding plate is exposed from the first insulated housing; and the second terminal module comprises a second insulated housing and a plurality of second terminals, the second terminals are in the second insulated housing, and at least one portion of each of the second terminals is exposed from the second insulated housing a grounding member disposed in the terminal module and between the first terminal module and the second terminal module, and comprising two side protrusions and two protruding structures, wherein the two side protrusions are engaged with the two grooves, so that the grounding member and the first insulated housing are assembled with each other, the protruding structures are respectively extending from the side protrusions, and the protruding structures are in contact with the grounding plate; and a metallic shell enclosing the terminal module, wherein the metallic shell defines an insertion opening.

* * * * *